US007410273B2

(12) United States Patent
Lin

(10) Patent No.: US 7,410,273 B2
(45) Date of Patent: Aug. 12, 2008

(54) LED LAMP ASSEMBLY

(75) Inventor: Chin-Sung Lin, Taichung County (TW)

(73) Assignee: Tera Autotech Corporation, Taichung (TW)

( * ) Notice: Subject to any disclaimer, the term of this patent is extended or adjusted under 35 U.S.C. 154(b) by 23 days.

(21) Appl. No.: 11/653,300

(22) Filed: Jan. 16, 2007

(65) Prior Publication Data

US 2008/0037258 A1 Feb. 14, 2008

(30) Foreign Application Priority Data

Aug. 8, 2006 (TW) ..... 95213975 U

(51) Int. Cl.
*F21V 7/00* (2006.01)

(52) U.S. Cl. ..... 362/296; 362/549; 362/800

(58) Field of Classification Search ..... 362/296, 362/547, 640, 652, 800; 313/512, 113; 257/98, 257/100

See application file for complete search history.

(56) References Cited

U.S. PATENT DOCUMENTS 5,457,900 A * 10/1995 Roy et al. ..... 36/137
6,364,506 B1 * 4/2002 Gallo ..... 362/245
6,648,488 B1 * 11/2003 Pearce ..... 362/96
6,791,840 B2 * 9/2004 Chun ..... 361/715
7,182,627 B1 * 2/2007 Huang ..... 439/487
7,234,842 B2 * 6/2007 Frederico ..... 362/277
2004/0037088 A1 * 2/2004 English et al. ..... 362/545
2004/0042208 A1 * 3/2004 Wu ..... 362/245
2005/0161692 A1 * 7/2005 Galli ..... 257/98

* cited by examiner

*Primary Examiner*—Ali Alavi
(74) *Attorney, Agent, or Firm*—Browdy and Neimark

(57) ABSTRACT

An LED lamp assembly includes a reflection cup, a lamp holder and an LED lamp. The reflection cup has a bottom wall with two through holes for insertion of electric wires and at least one locating hole, and a periphery wall defined with the bottom wall a recessed chamber. The lamp holder is mounted on the bottom wall of the reflection cup and located inside the recessed chamber. The lamp holder has a top wall, a peripheral wall extending from the top wall, and at least one mounting leg extending from the periphery wall of the lamp holder and coupled to the at least one locating hole of the reflection cup. The LED lamp is disposed between the top and periphery walls of the lamp holder and provided with two exposed conducting terminals corresponding to the two through holes of the reflection cup for connection with the electric wires.

10 Claims, 3 Drawing Sheets

LED LAMP ASSEMBLY

BACKGROUND OF THE INVENTION

1. Field of the Invention

The present invention relates generally to light emitting diode (LED) lamps and more particularly, to an LED lamp assembly, which has a simple structure and is easy to assemble.

2. Description of the Related Art

A conventional LED lamp assembly for projecting light, as shown in FIGS. 1 and 2, comprises an LED lamp 1 mounted on and electrically connected to an aluminum substrate 2, two electric wires 3 respectively soldered to the aluminum substrate 2 and electrically connected to positive and negative terminals of the LED lamp 1, and a cup 5 that holds the aluminum substrate 2. The aluminum substrate 2 is fixedly fastened to the top surface of the bottom wall of the cup 5 with screws 4, allowing the electric wires 3 to be extended to the outside of the cup 5 for connection to power supply.

The assembly procedure of the aforesaid conventional LED lamp assembly is complicated. During installation, the LED lamp 1 must be bonded to the aluminum substrate 2 at first, and then the aluminum substrate 2 is supported on the top surface of the bottom wall of the cup 5 with the respective mounting through holes at the aluminum substrate 2 respectively aimed at the respective screw holes at the bottom wall of the cup 5, and then screws 4 are respectively inserted through the mounting through holes of the aluminum substrate 2 and threaded into the respective screw holes at the cup 5 to affix the aluminum substrate 2 to the cup 5. Because this design of LED lamp assembly is complicated and comprised of a number of parts, the installation of the LED lamp assembly needs much time and labor.

SUMMARY OF THE INVENTION

The present invention has been accomplished under the circumstances in view. It is therefore one objective of the present invention to provide an LED lamp assembly, which has a simple structure that is easy to assemble.

It is another objective of the present invention to provide an LED lamp assembly, which has the component parts thereof made convenient for connection to one another.

To achieve these objectives of the present invention, the LED lamp assembly provided by the present invention comprises a reflection cup, a light emitting diode lamp and a lamp holder. The reflection cup has a bottom wall with two through holes for insertion of electric wires and at least one locating hole, and a periphery wall defined with the bottom wall a recessed chamber. The lamp holder is mounted on the bottom wall of the reflection cup and located inside the recessed chamber. The lamp holder has a top wall, a peripheral wall extending from the top wall, and at least one mounting leg extending from the periphery wall of the lamp holder and coupled to the at least one locating hole of the reflection cup. The LED lamp is disposed between the top and periphery walls of the lamp holder and provided with two exposed conducting terminals corresponding to the two through holes of the reflection cup for connection with the electric wires.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
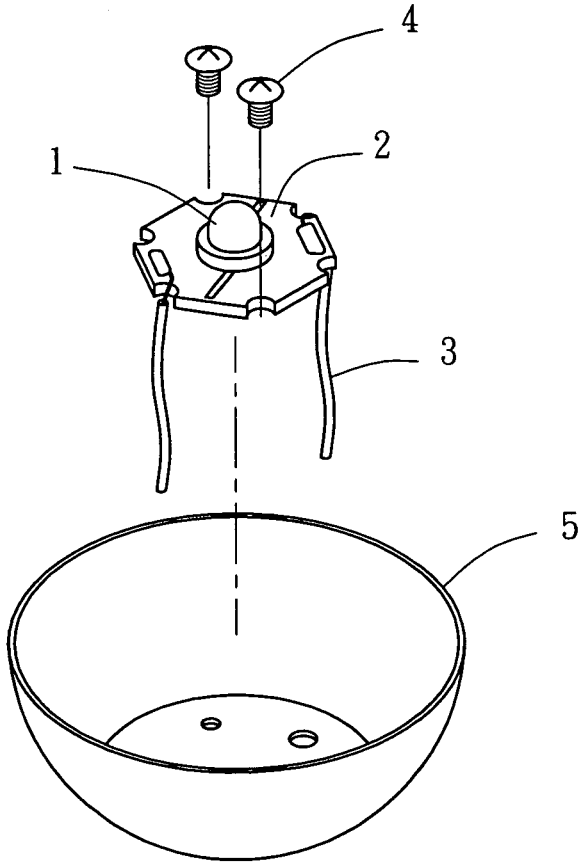
FIG. 1 PRIOR ART
FIG. 1 is an exploded view of an LED lamp assembly according to the prior art.
Figure 2:
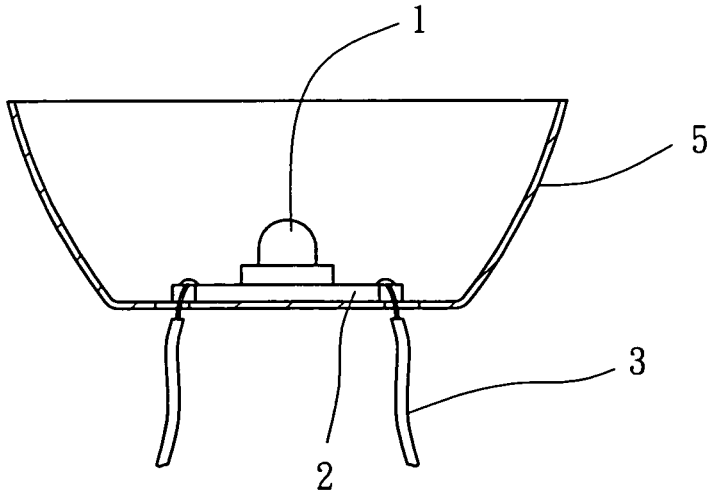
FIG. 2 PRIOR ART
FIG. 2 is a sectional assembly view of the LED lamp assembly according to the prior art.
Figure 3:
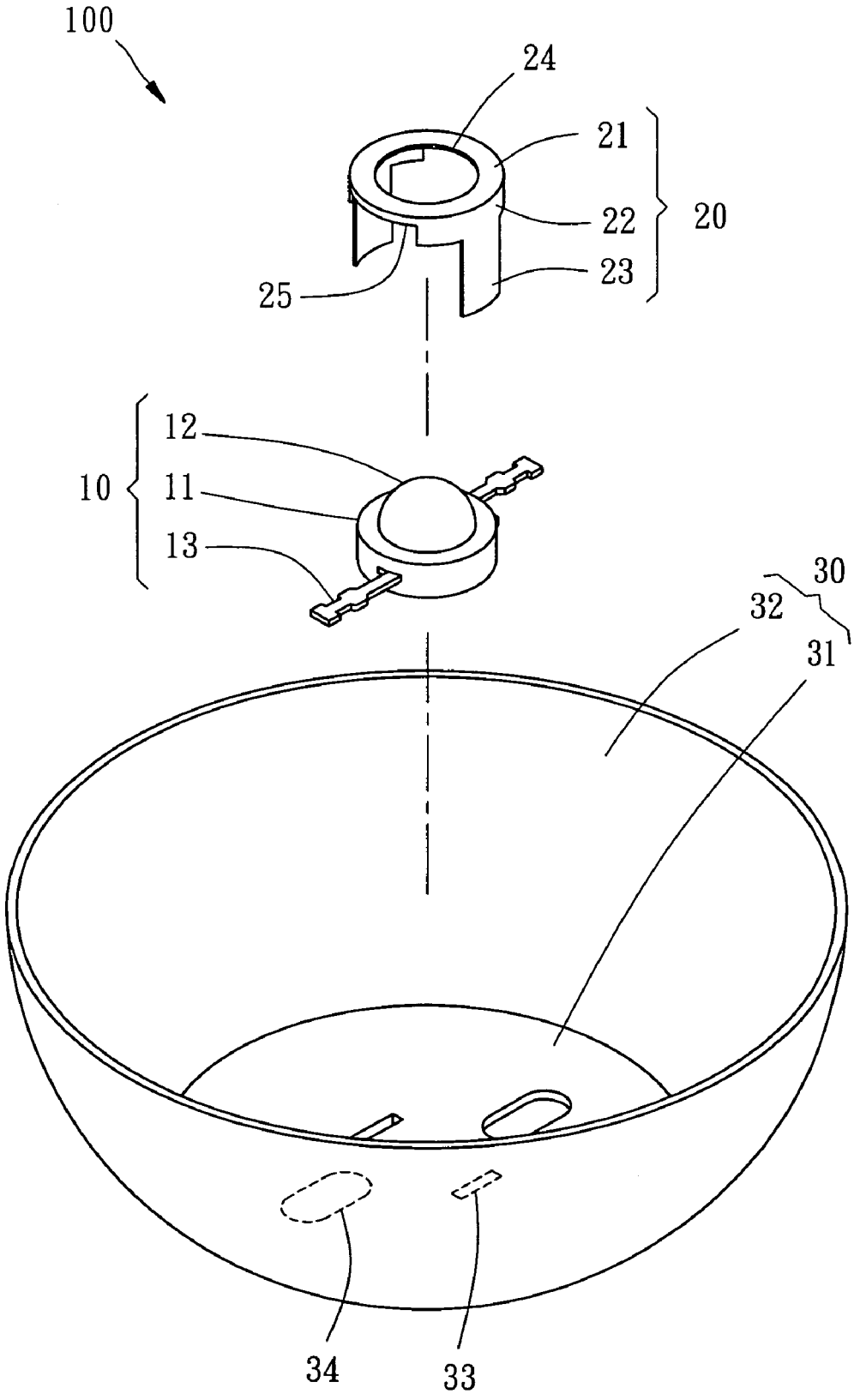
FIG. 3 is an exploded view of an LED lamp assembly according to a preferred embodiment of the present invention.
Figure 4:
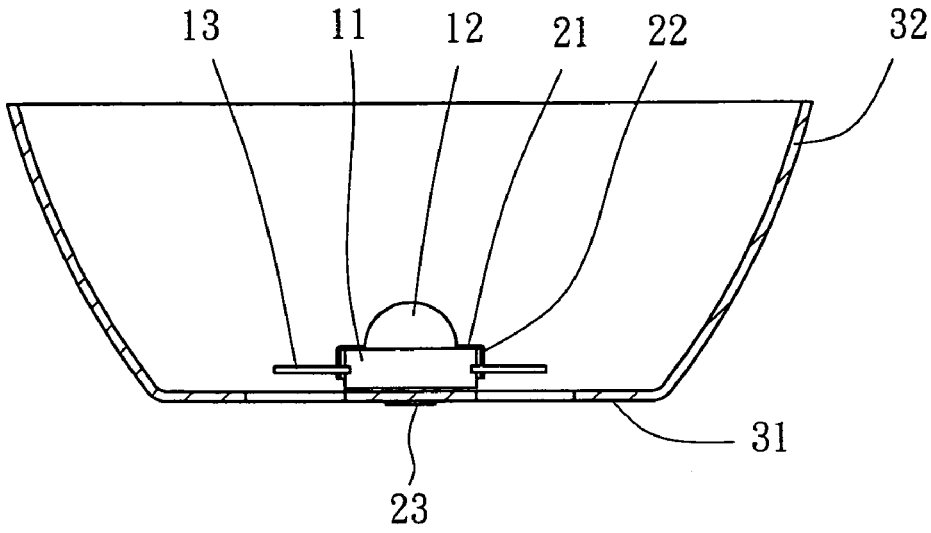
FIG. 4 is a sectional assembly view of the LED lamp assembly according to the preferred embodiment of the present invention.
Figure 5:
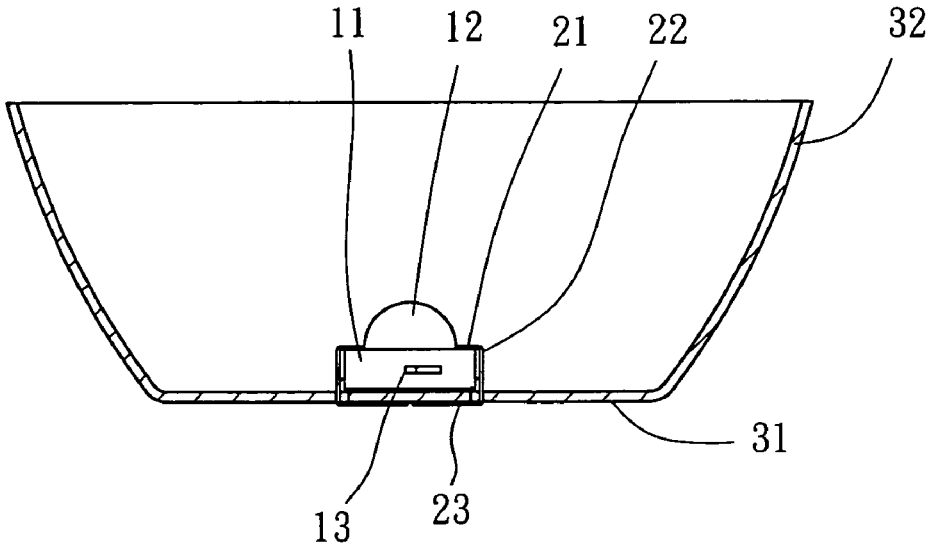
FIG. 5 is another sectional assembly view of the LED lamp assembly according to the preferred embodiment of the present invention.

Referring to FIGS. 3-5, an LED lamp assembly 100 in accordance with a preferred embodiment of the present invention is shown comprising an LED (light emitting diode) lamp 10, a lamp holder 20, and a reflection cup 30.

The LED lamp 10 is constructed subject to standard specifications in LED industry, having a base 11, an LED device (not shown), a lens 12, and two conducting terminals 13 exposed outside the base 11. The base 11 is molded from an electrically insulative plastic material. The LED device comprises a circuit board and at least one LED mounted on the circuit board. When electric current is connected to the circuit board, the LED at the circuit board is turned on to give off light. The LED device is mounted on the base 11. The lens 12 is covered on the base 11 to enclose the LED device. The lens 12 is made of a light transmissive material so that the light produced by the LED of the LED device passes through the lens 12 to the outside. The two conducting terminals 13 are respectively fastened to the base 11 at two opposite sides, each having one end respectively extending to the inside of the base 11 and electrically connected to the LED device and the other end suspending outside the base 11 for connection to power supply for enabling electric current to be transmitted to the LED device.

The lamp holder 20 is made of aluminum in integrity, having an annular top wall 21, an annular peripheral wall 22 perpendicularly downwardly extending around the border of the annular top wall 21, two mounting legs 23 perpendicularly downwardly extending from the annular peripheral wall 22 at two opposite sides, an opening 24 provided at the center of the annular top wall 21, and two locating notches 25 formed on the bottom edge of the annular peripheral wall 22 at two opposite sides.

The reflection cup 30 is made of aluminum in integrity, having a flat circular bottom wall 31 and a periphery wall 32 upwardly extending from the border of the flat circular bottom wall 31. The flat circular bottom wall 31 and the periphery wall 32 define a recessed chamber. Further, the flat circular bottom wall 31 has two locating holes 33 and two through holes 34.

The assembly process and features of the LED lamp assembly 100 are described hereinafter. At first, the base 11 of the LED lamp 10 is directly set in the annular peripheral wall 22 of the lamp holder 20 and stopped at the bottom side of the annular top wall 21 to have the lens 12 pass through the opening 24 and the terminals 13 be respectively secured to the locating notches 25 of the lamp holder 20. After positioning of the LED lamp 10 in the lamp holder 20, the mounting legs 23 of the lamp holder 20 are respectively inserted through the locating holes 33 of the reflection cup 30 from the top side and then respectively bent and closely attached to the bottom surface of the flat circular bottom wall 31 of the reflection cup 30 (see FIG. 5), thereby securing the lamp holder 20 and the LED lamp 10 firmly to the reflection cup 30. After installation of the lamp holder 20 with the LED lamp 10 in the reflection cup 30, the two terminals 13 of the LED lamp 10 are respectively positively positioned in the locating notches 25 corresponding to the through holes 34 of the reflection cup 30 (see FIG. 4). External electric wires (not shown) can be respectively inserted through the through holes 34 of the reflection cup 30 and bonded to the terminals 13. Thus, electric current can be transmitted to the LED lamp 10, causing the LED of the LED lamp 10 to give off light through the lens 12. Further, the periphery wall 32 of the reflection cup 30 reflects the light of the LED lamp 10 onto an external fixed point, enhancing the light intensity.

As stated above, the invention uses a lamp holder to secure an LED lamp to a reflection cup and to hold the LED lamp firmly in place, keeping the terminals of the LED lamp in alignment with the respective through holes on the reflection cup for the connection of the respective electric wires. The LED lamp assembly has a simple structure containing a limited number of parts. Therefore, the invention saves much material cost and simplifies the installation procedure.

The above-stated embodiment is simply an example of the present invention. As an alternate form of the present invention, the aforesaid lamp holder may be eliminated, and the LED lamp may be made having at least one, for example two mounting legs formed integral with the bottom side of the base for fastening to the reflection cup. This alternate form has a relatively simple structure and achieves the same effect.

What is claimed is:

1. An LED lamp assembly comprising:

a reflection cup having a bottom wall with two through holes for insertion of electric wires and at least one locating hole, and a periphery wall defined with the bottom wall a recessed chamber;

a lamp holder mounted on the bottom wall of the reflection cup and located inside the recessed chamber, the lamp holder having a top wall, a peripheral wall extending from the top wall, and at least one mounting leg extending from the periphery wall of the lamp holder and coupled to the at least one locating hole of the reflection cup; and a light emitting diode lamp disposed between the top and periphery walls of the lamp holder and provided with two exposed conducting terminals corresponding to the two through holes of the reflection cup for connection with the electric wires.

2. The LED lamp assembly as claimed in claim 1, wherein the light emitting diode lamp comprises a base, a light emitting diode device mounted on the base, a lens covered on the base over the light emitting diode device, and the two conducting terminals, the two conducting terminals each having one end embedded in the base and electrically connected to the light emitting diode device and the other end exposed outside the base.

3. The LED lamp assembly as claimed in claim 2, wherein the light emitting diode device comprises a circuit board and at least one light emitting diode mounted on the circuit board and electrically connected to the conducting terminals; wherein the lens is made of light transmissive material.

4. The LED lamp assembly as claimed in claim 1, wherein the lamp holder is made of aluminum in integrity.

5. The LED lamp assembly as claimed in claim 1, wherein the top wall of the lamp holder is an annular wall having an opening through which light produced by the light emitting diode lamp passes; the peripheral wall of the lamp holder extends perpendicularly downwards along the top wall of the lamp holder and has two bottom notches symmetrically disposed at two opposite sides for securing the conducting terminals.

6. The LED lamp assembly as claimed in claim 1, wherein the reflection cup is made of aluminum.

7. The LED lamp assembly as claimed in claim 1, wherein the at least one mounting leg of the lamp holder is inserted through the at least one locating hole and bent to closely attach to a bottom surface of the bottom wall of the reflection cup.

8. The LED lamp assembly as claimed in claim 1, wherein the peripheral wall of the reflection cup upwardly integrally extends from the border of the bottom wall of the reflection cup to form the recessed chamber therein.

9. The LED lamp assembly as claimed in claim 8, wherein the peripheral wall of the reflection cup is adapted to reflect the light produced by the light emitting diode lamp onto a fixed location outside the LED lamp assembly.

10. An LED lamp assembly comprising:

a reflection cup having a bottom wall with two through holes and at least one locating hole, and a periphery wall defined with the bottom wall a recessed chamber; and a light emitting diode lamp mounted on the bottom wall of the reflection cup and located inside the recessed chamber, the light emitting diode lamp having two exposed conducting terminals corresponding to the two through holes of the reflection cup, and at least one mounting leg coupled to the at least one locating hole of the reflection cup.

* * * * *